US010407804B2

(12) United States Patent
Benelli

(10) Patent No.: US 10,407,804 B2
(45) Date of Patent: Sep. 10, 2019

(54) ELASTICISED YARN, A METHOD FOR MAKING SAID YARN AND ELASTICISED FABRIC MADE THEREFROM

(76) Inventor: Paolo Benelli, Prato (IT)

( * ) Notice: Subject to any disclaimer, the term of this patent is extended or adjusted under 35 U.S.C. 154(b) by 670 days.

(21) Appl. No.: 13/882,725

(22) PCT Filed: Oct. 31, 2011

(86) PCT No.: PCT/IB2011/054842
§ 371 (c)(1),
(2), (4) Date: May 15, 2013

(87) PCT Pub. No.: WO2012/056436
PCT Pub. Date: May 3, 2012

(65) Prior Publication Data

US 2013/0251974 A1 Sep. 26, 2013

(30) Foreign Application Priority Data

Oct. 30, 2010 (IT) ..... PI2010A0123
Mar. 14, 2011 (IT) ..... PI2011A0022

(51) Int. Cl.
*D02G 3/04* (2006.01)
*D02G 3/32* (2006.01)

(52) U.S. Cl.
CPC ..... *D02G 3/04* (2013.01); *D02G 3/322* (2013.01); *D10B 2201/06* (2013.01); *D10B 2201/08* (2013.01); *Y10T 428/249922* (2015.04)

(58) Field of Classification Search
CPC ..... D02G 3/04; D02G 3/322; Y10T 428/249922; D10B 2201/08
(Continued)

(56) References Cited

U.S. PATENT DOCUMENTS 2,024,155 A * 12/1935 Foster ..... D02G 3/32 57/225
2,103,133 A 12/1937 Adamson
(Continued)

FOREIGN PATENT DOCUMENTS

| | | |
|---|---|---|
| EP | 2 236 654 A1 | 10/2010 |
| GB | 380368 | 9/1932 |
| WO | 03/060211 A1 | 7/2003 |

*Primary Examiner* — Vincent Tatesure
(74) *Attorney, Agent, or Firm* — Ladas & Parry LLP; Malcolm J. MacDonald

(57) ABSTRACT

An elastic thread yarn comprising linen and/or ramié and/or hemp and an elastic thread, with a thread made of an elastomeric material, and a substantially inextensible yarn made of linen and/or ramié and/or hemp helically wound about the elastomeric core at a predetermined number of windings per length unit of elasticized yarn, wherein, for each metric count Nm, the number of windings substantially inextensible yarn of the elasticized yarn, is set between two values indicated by two curves (12, 13) which can be expressed according to exponential laws, for example, with the same exponent, i.e. according to equations of the form $T=K\,N^{0,327}$ where K is 20 and 50, respectively. In particular, an intermediate curve 11 is such that, by choosing for a given metric count a number of windings proximate to curve 11, this best feature balance is obtained. In an exemplary embodiment, the core comprises a bare elastic thread, i.e. an elastic thread that is not coated by other fibers. In another exemplary embodiment, the core comprises an elastic thread coated with a natural fiber as cotton or viscose, or with a combination thereof. The elastic thread yarn according to the invention provides elasticized fabrics containing linen and/or on ramié, which has, in particular, a better surface regularity than well-known elasticized fabrics comprising linen, and which is comparable with the regularity of the elasticized fabrics comprising natural fibers such as cotton,
(Continued)

wool, etc. and synthetic fibers, and also allows using ramie and hemp yarns to make elastic thread yarns and fabrics, for example, for making cloth items.

34 Claims, 1 Drawing Sheet

(58) Field of Classification Search
USPC ..... 428/222, 357
See application file for complete search history.

(56) References Cited

U.S. PATENT DOCUMENTS

| | | | | |
|---|---|---|---|---|
| 2,229,673 | A | 1/1941 | Rosenfeld | |
| 3,387,448 | A | 6/1968 | Lathem et al. | |
| 2009/0139601 | A1* | 6/2009 | Karayianni | D02G 3/328<br>139/421 |
| 2009/0191777 | A1* | 7/2009 | Liao | 442/184 |

* cited by examiner

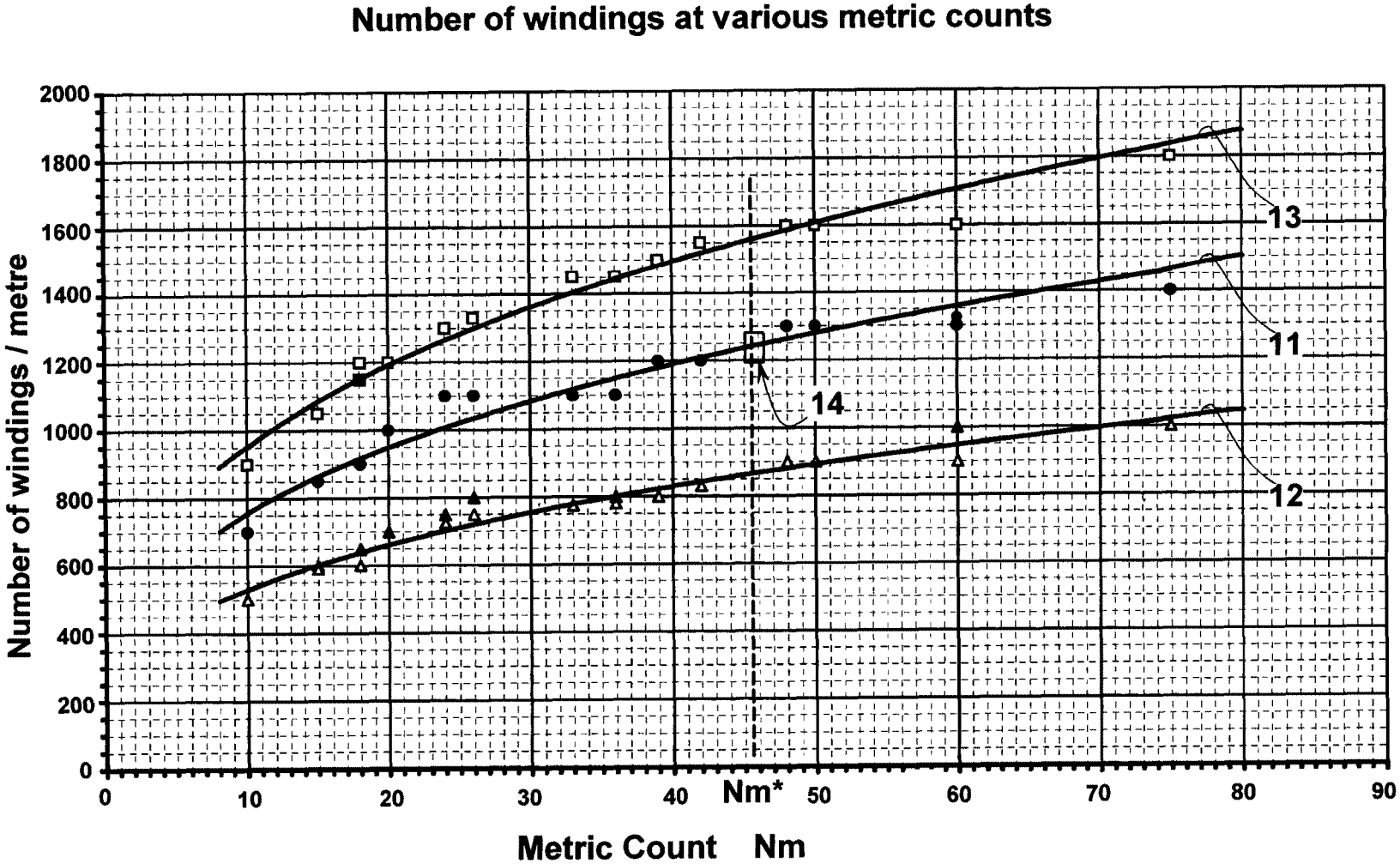
Number of windings at various metric counts
Number of windings / metre
2000
1800
1600
1400
1200
1000
800
600
400
200
0
0
10
20
30
40
50
60
70
80
90
Nm*
Metric Count Nm
13
11
12
14

ELASTICISED YARN, A METHOD FOR MAKING SAID YARN AND ELASTICISED FABRIC MADE THEREFROM

This application is a 371 of PCT/IB2011/054842, filed on Oct. 31, 2011, which claims priority to Italian Patent Application No. PI2010A000123, filed Oct. 30, 2010, and Italian Patent Application No. PI2011A000022, filed Mar. 14, 2011.

SCOPE OF THE INVENTION

The present invention relates to elastic thread yarns based on natural fibres such as linen, ramié or hemp, and to fabrics produced starting from such yarns.

The invention relates also to a method for making such elastic thread yarns.

BACKGROUND OF THE INVENTION

Technical Problem

Since some decades, elasticized fabrics made from elastic thread yarns of many kinds are used. The advantage of such fabrics consists of a high deformability of the items that are obtained from them. In particular, garments are made such as garments that do not hinder who wears them, or conform themselves to the movement of the users, thus generating a comfort sensation. This is particularly appreciated in underwear clothing or in sport and gym clothes, but also in everyday life situations such as when sitting in a car, and the like. Furthermore, elasticized fabrics are also used to make bandages, dressings and garments for treating sprains, wounds, inguinal hernia and the like. Besides, elasticized fabrics are advantageous for making general-purpose gloves.

The features of an elasticized fabric depend upon the high elasticity of the elastic thread yarn used for their production.

Methods are known to obtain elastic thread yarns from substantially inextensible yarns such as wool, cotton, as well as various synthetic fibres. Such methods provide winding the inextensible yarn about a core that comprises an elastic thread, forming a sort of helix about the elastic thread. The above step can usually be performed in a hollow spindle twisting machine.

The result of such step is a product that has better comfort features than the inextensible yarn itself, due to the elastic thread. A determined stretch of the so-obtained elasticized product causes a progressive reversible elongation of the helix along the elastomeric core, in such a way that the windings move away from one another. When the stretch is released, the windings of the helix substantially revert to the starting conformation, which allows an elastic recovery of the yarn and of the fabric that is made of the yarn.

In particular, GB380368 describes elastic thread yarns that are well suited to be worked in high production rate knitting machines, which are provided with narrow orifices, in particular to produce two-direction elasticized fabrics. Such elastic thread yarns are characterized by an elastic thread that has a diameter shorter than 1/40" (0.635 mm). Among the covering yarns, wool, linen, silk etc. can be used, even if in most cases the covering yarn is cotton or silk.

U.S. Pat. No. 2,229,673 describes an apparatus for covering an elastic thread with an inextensible yarn, e.g. a cotton, linen, silk, wool yarn, etc., to obtain an elastic thread yarn with uniform elastic properties. The apparatus comprises a means for progressively increasing, in particular for automatically increasing the speed of a feeding spool containing the inextensible yarn, responsive to the amount of yarn that has to be wound.

U.S. Pat. No. 3,387,448 describes other elastic thread yarns whose production comprises, in particular, a thermal treatment of the elastic thread.

Elasticized products are also known in which the substantially inextensible covering yarn comprises linen, or consists of a yarn of linen. However, such elasticized products have poorer surface features than the products obtained from other textile fibres. More in detail, during the manufacture and the use, the well-known linen-containing elasticized fabrics form small masses or lumps of material distributed on their own surface. Accordingly, they are coarser and less comfortable than other elasticized fabrics, besides showing a rougher look. Such defect is known in Italy as the "orange skin" effect.

To overcome this drawback, elastic thread yarns covered by linen yarn have been produced in which the thread consists of an already coated elastic thread, for example, nylon fibre-covered ones. By this technique, linen elastic yarns are obtained which have the drawback of not allowing a single-step dying operation and/or a single-dying-agent dying operation. In fact, the dying agents that can dye the linen fibres are not adapted to dye the nylon yarn that covers the core, and vice-versa. Moreover, these elastic thread yarns cannot provide an elasticity, a comfort and a tactile sensation, i.e. a "hand" sensation, like the elastic thread yarns based on other textile fibres can provide.

Since the ancient times, it is well-known using a ramié textile fibre, or a ramia textile fibre, (*Boehmeria nivea*) which has white and brilliant long and thin fibres. In other words, ramié fabric has features that are similar to the features of such a valuable fabric as silk. Owing to this reason, and to the increasing need of natural fibres, the interest for ramié is more and more increasing.

The cellulosic structure of ramié is much more crystalline and more porous than the structure of other fibres. Accordingly, ramié is one of the most resistant natural fibres, and maintains this property even in a wet state. This makes ramié particularly well suited for making water resistant products and, more in general, high resistance products. This is the case of ropes, strings, sails, clothes, tablecloths, and interior decoration products. In clothing, ramié fabrics can be comfortably worn, also in warm climates. Ramié has a good resistance against alkali substances and diluted acids, as well as against degradation by light and mould. Moreover, ramié is much easier to dye than other yarns. Ramié is also less expensive than other yarns, for example than linen. The higher the linear density, the higher the convenience of ramié. Ramié is commercially available in linear densities from 5 Nm to 72 Nm.

However, ramié is relatively not very elastic. For example, it is normally stiffer than linen. Like linen, ramié is a rigid fibre, not very elastic and prone to crease. If it is elasticized by a conventional technique, for instance by the techniques that are in use for linen, also ramié shows the above-mentioned "orange skin" effect. For this reason, it is normally blended with other fibres, in particular cotton or polyester. This reduces however the brilliance properties of ramié, and requires preferably anti-crease final treatments. In this form, ramié is especially used for making knitwear.

Since the ancient time, the production of hemp yarns and fabrics (*Cannabis sativa*) is also known, in particular, for making such items as bedsheets and tablecloths. For these uses, hemp has been progressively replaced by synthetic fibres that show better surface properties. Even in clothing, the use of hemp is limited, due to its low elasticity and its tendency to crease. If it is elasticized by conventional techniques, for instance by techniques that are in use for linen, also hemp shows the "orange skin" effect.

However, hemp is available in large amount and at a cost more convenient than other fibres. Therefore, if it is worked, in such a way to solve the above-described problems, hemp could provide a preferred material to make elastic thread yarns and elastic fabrics for clothing.

SUMMARY OF THE INVENTION

Therefore, the present invention aims at providing an elastic thread yarn containing stiff and relatively poor elastic fibres, which is adapted to make an elastic fabric substantially free from small yarn masses or yarn lumps distributed on the surface of the fabric, and that has a surface roughness and a look comparable with other commercially-available elasticized fabrics that contain cotton, wool or other natural and/or synthetic fibres.

It is, furthermore, a feature of the present invention to provide such a yarn containing linen fibres.

It is also a feature of the present invention to provide such a yarn containing ramié fibres.

It is also a feature of the present invention to provide such a yarn containing hemp fibres.

It is a particular feature of the present invention to provide such an elastic thread yarn which has an elasticity at least comparable with other commercially-available elasticized fabrics.

The invention aims also at providing such a yarn which is easy and cheap to produce.

Another feature of the invention is to provide a method for preparing such an elastic thread yarn.

It is also comprised in the scope of the invention to provide an elasticized fabric based on stiff and relatively inelastic fibres, which is substantially free from the so-called "orange skin" defect, i.e. from small yarn masses or yarn lumps distributed on the surface of the fabric, and which has a surface roughness and a look comparable with other commercially-available elasticized fabrics that contain cotton, wool or other natural and/or synthetic fibres.

It is a particular feature of the present invention to provide such a fabric based on linen fibres.

It is, furthermore, a particular feature of the present invention to provide such a fabric based on ramié fibres.

It is also a particular feature of the present invention to provide such a fabric based on hemp fibres.

These and other objects are achieved by an elastic thread yarn comprising:

- an elastic thread, comprising a thread made of an elastomeric material;
- a substantially inextensible yarn that is helically wound about the elastic thread forming a predetermined number T of windings per length unit of elastic thread yarn;

wherein the substantially inextensible yarn comprises linen and/or ramié and/or hemp, said inextensible yarn having a predetermined metric count Nm, characterised in that the number T of windings per length unit is obtained by the equation $$T=K(1000\ \mathrm{Nm})^{\alpha} \quad [1]$$

where K is a number set between 20 and 50 and $\alpha$ is set between 0.30 and 0.35.

The expression "metric count" is used to mean a unit of yarn linear density, which is the length, expressed in kilometers, of 1 Kg of yarn.

Accordingly, the metric count is expressed in Km/Kg. An alternative yarn count measurement unit is tex, which is, inversely, the mass expressed in grams of 1 Km of yarn, or a submultiple of it, such as dtex (decitex). In particular, metric count Nm of the inextensible yarn is between 8 and 80.

The expression "number of torsions" or "of windings per meter" means the number of torsions that can be directly counted as the number of inverse torsions that is required for completely removing the windings on a predetermined length of a twisted yarn that has been arranged between two fixed points at a predetermined initial tensile stretch. In particular, the predetermined length and the initial tensile stretch are selected according to ISO 2061.

Spin tests were made starting from substantially inextensible linen yarns, ramié yarns and hemp yarns, in order to assess the validity of the equation between the number T of windings per length unit and the surface features of the fabrics that can be obtained from the yarns produced this way. According to these tests, the elastic thread yarns that are obtained at a number T of windings per length unit greater than a determined minimum value, which depends upon metric count Nm, allow to produce fabrics that are substantially free from surface irregularities such as small yarn masses or yarn lumps distributed on the surface, or fabrics that have a slight amount of such irregularities. In other words, the fabrics obtained this way are substantially free from the defects known as "orange skin" effect (it. "buccia d'arancia").

Starting from such an elastic thread yarn, in particular from a yarn that has been obtained with a number of windings per length unit greater than the conventional linen elastic thread yarns, elasticized fabrics are obtained that are smoother than conventional ones. In particular, this occurs even if the elastic thread yarn or the elasticized fabric is wet.

Such result is unexpected in the light of the common knowledge of production of elastic thread yarns. According to such common knowledge, by increasing the number of windings per length unit, beyond values that are even lower than said minimum values or close to them, a strong decrease of the elastic properties would be obtained. Such effect is even more expected, in the light of the technical common knowledge, for fibres that are intrinsically particularly stiffer, such as linen, ramié and, even more so, hemp.

The results that have been obtained can be explained as follows. In the yarns according to the invention, a higher reciprocal closeness of the windings allows the windings to remain beside one another, without interlacing, once the force that stretches the core during the spinning operation is released, for instance, on a hollow spindle twisting machine, i.e. during the operation by which the windings are formed.

The tests have shown that with a number of windings per length unit lower than the number T calculated by a formula such as [1], attraction forces arise between neighbouring portions of windings of linen yarn, hemp yarn or ramié yarn, which causes the windings to interlace. In other words, when shrinking, a linen, hemp or ramié elastic thread yarn that has a number of windings lower than the above-mentioned value, looses its structural regularity. Macroscopically, this causes the above-described so-called "orange skin" effect. On the contrary, with a number of torsions such as the one described by formula [1], this undesired effect does not take place.

The tests have also shown that any of the three above-mentioned covering yarns, i.e. linen, hemp and ramié yarns, can tolerate a maximum number of windings per meter of elastic thread yarn, without substantially loosing the elastic properties. Also this maximum value depends upon the metric count Nm, the relationship between the above-mentioned maximum value of windings and the metric count can be described by an exponential correlation according to formula [1]. On the contrary, a number of windings larger than this minimum value, causes an excessive stiffening of the elastic thread yarn produced, and the elastic properties are lost.

It has been also observed that, in the above-described operative conditions, ramié and hemp can be used for making a elastic thread yarn that has elastic properties similar to the elastic properties of fabrics that are obtained by another raw material. In other words, ramié- and hemp-based elastic thread yarns can be obtained which are adapted to make general-purpose elasticized fabrics and, in particular, clothing. Also the ramié and hemp fabrics that are obtained by the above yarns, are free from the orange skin effect.

In particular, K is a number set between 25 and 47, more in particular, it is set between 30 and 42, even more in particular, K is a number set between 35 and 40, even more in particular, K is about 37.3. In particular, $\alpha$ is a number set between 0.32 and 0.33.

Still according to the tests, the coefficient $\alpha$ may be advantageously set between 0.32 and 0.33 and the coefficient K may be advantageously set between 25.9 and 46.7.

The statistic probability that a fabric that is obtained starting from such a yarn has the above-described surface irregularities decreases regularly if a number of windings or torsions per linear meter of elastic thread yarn, for a given metric count value, is used according to an equation of the form [1], in which K is set between 25 and 35. In particular, significant improvements are obtained, with respect to a yet acceptable result, if K is about 25.9, 30 and 35, respectively.

Similarly, an elastic thread yarn, and an elasticized fabric obtained from it, have better elastic properties, in terms of decrease of the elastic tensile modulus, if the number of windings or torsions per linear meter of elastic thread yarn is given by an equation of the form [1], wherein K is set between 47 and 40 In particular, relevant improvements are obtained, with respect to a yet acceptable result, if K is lower than 46.7, 42 and 40, respectively.

In particular, the substantially inextensible yarn is a linen yarn that has a metric count Nm set between 8 and 80. Typically, the metric count is selected among 10, 24, 26, 36, 39, 50 and 75, these values containing the metric count values of most commercially-available substantially inextensible linen yarn.

In a particular exemplary embodiment, the inextensible yarn of the linen elastic thread yarn has a metric count Nm of 10, and the number T of windings is set between 500 and 900 windings per meter of elastic thread yarn. In particular, the number of windings per meter is set between 650 and 850, more in particular, the number T of windings is about 700 windings per meter.

In a particular exemplary embodiment, the inextensible yarn of the linen elastic thread yarn has a metric count Nm of 24, and the number T of windings is set between 750 and 1300 windings per meter of elastic thread yarn. In particular, the number of windings per meter is set between 850 and 1250, more in particular, the number T of windings is about 1100 windings per meter.

In a particular exemplary embodiment, the inextensible yarn of the linen elastic thread yarn has a metric count Nm of 26, and the number T of windings is set between 800 and 1300 windings per meter of elastic thread yarn. In particular, the number of windings per meter is set between 900 and 1250, more in particular, the number T of windings is about 1100 windings per meter.

In a particular exemplary embodiment, the inextensible yarn of the linen elastic thread yarn has a metric count Nm of 36, and the number T of windings is set between 800 and 1400 windings per meter of elastic thread yarn. In particular, the number of windings per meter is set between 900 and 1350, more in particular, the number T of windings is about 1100 windings per meter.

In a particular exemplary embodiment, the inextensible yarn of the linen elastic thread yarn has a metric count Nm of 39, and the number T of windings is set between 800 and 1400 windings per meter of elastic thread yarn. In particular, the number of windings per meter is set between 900 and 1350, more in particular, the number T of windings is about 1100 windings per meter.

In a particular exemplary embodiment, the inextensible yarn of the linen elastic thread yarn has a metric count Nm of 50, and the number T of windings is set between 900 and 1600 windings per meter of elastic thread yarn. In particular, the number of windings per meter is set between 1000 and 1500, more in particular, the number T of windings is about 1300 windings per meter.

In a particular exemplary embodiment, the inextensible yarn of the linen elastic thread yarn has a metric count Nm of 75, and the number T of windings is set between 1000 and 1800 windings per meter of elastic thread yarn. In particular, the number of windings per meter is set between 1100 and 1700, more in particular, the number T of windings is about 1300 windings per meter.

In particular, the substantially inextensible yarn is a ramié yarn that has a metric count set between 8 and 60. Typically, the metric count is selected among 10, 24, 36, 48 and 60. In this case, the ramié elastic thread yarn has a number of windings of yarn that is wound on each unit of its length set between 500 and 1500 windings per meter of elastic thread yarn.

In a particular exemplary embodiment, the inextensible yarn of the ramié elastic thread yarn has a metric count Nm of 10, and the number T of windings is set between 500 and 900 windings per meter of elastic thread yarn. In particular, the number of windings per meter is set between 650 and 850, more in particular, the number T of windings is about 700 windings per meter.

In a particular exemplary embodiment, the inextensible yarn of the ramié elastic thread yarn has a metric count Nm of 24, and the number T of windings is set between 750 and 1300 windings per meter of elastic thread yarn. In particular, the number of windings per meter is set between 850 and 1250, more in particular, the number T of windings is about 1100 windings per meter.

In a particular exemplary embodiment, the inextensible yarn of the ramié elastic thread yarn has a metric count Nm of 36, and the number T of windings is set between 800 and 1400 windings per meter of elastic thread yarn. In particular, the number of windings per meter is set between 900 and 1350, more in particular, the number T of windings is about 1100 windings per meter.

In a particular exemplary embodiment, the inextensible yarn of the ramié elastic thread yarn has a metric count Nm of 48, and the number T of windings is set between 800 and 1600 windings per meter of elastic thread yarn. In particular, the number of windings per meter is set between 1000 and 1500, more in particular, the number T of windings is about 1300 windings per meter.

In a particular exemplary embodiment, the inextensible yarn of the ramié elastic thread yarn has a metric count Nm of 60, and the number T of windings is set between 900 and 1600 windings per meter of elastic thread yarn. In particular, the number of windings per meter is set between 1000 and 1500, more in particular, the number T of windings is about 1300 windings per meter.

In particular, the substantially inextensible yarn is a hemp yarn that has a metric count set between 8 and 40. Typically, the metric count is selected among 10, 18, 24 and 36.

In a particular exemplary embodiment, the inextensible yarn of the hemp elastic thread yarn has a metric count Nm of 10, and the number T of windings is set between 500 and 900 windings per meter of elastic thread yarn. In particular, the number of windings per meter is set between 650 and 850, more in particular, the number T of windings is about 700 windings per meter.

In a particular exemplary embodiment, the inextensible yarn of the hemp elastic thread yarn has a metric count Nm of 18, and the number T of windings is set between 600 and 1200 windings per meter of elastic thread yarn. In particular, the number of windings per meter is set between 750 and 1150, more in particular, the number T of windings is about 900 windings per meter.

In a particular exemplary embodiment, the inextensible yarn of the hemp elastic thread yarn has a metric count Nm of 24, and the number T of windings is set between 750 and 1300 windings per meter of elastic thread yarn. In particular, the number of windings per meter is set between 850 and 1250, more in particular, the number T of windings is about 1100 windings per meter.

In a particular exemplary embodiment, the inextensible yarn of the hemp elastic thread yarn has a metric count Nm of 36, and the number T of windings is set between 800 and 1400 windings per meter of elastic thread yarn. In particular, the number of windings per meter is set between 900 and 1350, more in particular, the number T of windings is about 1100 windings per meter.

In particular, the elastically extensible thread is an elastomer such as a polyurethane synthetic fibre. In particular, this elastic thread comprises at least 85% of segmented polyurethane. Such synthetic thread can be a synthetic thread that is commercially known as Lycra or as Elastan.

Preferably, the thread of elastomeric material has a metric count, i.e. a linear density, set between 70 dtex and 250 dtex. Even more preferably, the elastomeric material of the thread has a metric count set between 100 dtex and 200 dtex, more in particular, the metric count of the elastomer is set between 145 and 165 dtex, even more in particular, the metric count is about 156 dtex.

Preferably, the elastic thread yarn is produced by stretching the elastic thread until an extension is reached between 3 and 4.5 times the natural length of the elastic thread, i.e. the length of the elastic thread when this is not extended. In particular, such extension, also known as the stretch ratio, is about 3.9.

The result obtained with elastic threads that have a metric count undoubtedly larger than the elastic threads commonly used for making conventional elastic thread yarns is particularly important and unexpected in the light of the technical common knowledge. In fact, in the field of fabrics for clothing, the use of elastic thread of metric count set between 100 dtex and 200 dtex, for example about 156 dtex, and in particular at a stretch ratio of 3.9, is limited to the production of technical fabrics, which fulfill particular mechanical strength and tightness requirements. When shrinking, such an elastic thread exerts a tensile force higher than lower metric count (e.g. 44 dtex) elastic threads, which are normally used for making cloth yarns. Such force contrasts the stiffness of linen, hemp or ramie fibres, which gives elasticity to the elastic thread yarn and packs the windings in such a way that they are maintained in a regular spring-like shape, even at the curved portions and/or joint portions of the yarns forming the fabric. According to the common knowledge about the production of elasticized fabrics for cloths, it would have been impossible to attain such a result, i.e. the expected result wouldn't have been an elastic yarn and fabric, but a stiff yarn and fabric, unusable for making normal garments (fashion clothes).

A well-known elastic thread that can be used in the elastic thread yarns according to the invention is Lycra®, in particular Lycra® 156 dtex, at a stretch ratio of 3.9, even if, in the light of the results, it is possible to use different elastomers at stretch ratios different from 3.9.

In a particular exemplary embodiment, the core comprises a bare elastic thread, i.e. a thread made of an elastomeric material as such, not coated by any other fibre. The possibility of making an elasticized fabric with a bare elastic thread allows a single-step yarn-dyeing operation. In fact, the elastic thread, due to its small size, does not require dyeing, unlike synthetic fibres like nylon, which are used for coating the elastic thread in the manufacture of some linen elasticized fabrics, and the above-mentioned problems arise.

In another exemplary embodiment, the thread comprises a barer elastic thread coated with a natural fibre. The natural fibre may be cotton, or viscose, or a combination of cotton and of viscose.

The scope of the invention comprises also an elasticized fabric that has at least one part made of the above-described elastic thread yarn.

Furthermore, it falls within the scope of the invention a method for making an elastic thread yarn comprising the steps of:

- prearranging a first spool containing a substantially inextensible yarn comprising linen and/or ramié and/or hemp;
- prearranging a second spool containing an elastic thread;
- co-axially mounting the first spool on a hollow cylinder that is adapted to rotate about its own axis at a predetermined speed;
- pulling the elastic thread from the second spool through the hollow cylinder at an unwinding speed;
- causing the elastic thread, together with the linen and/or ramié and/or hemp-containing yarn, to pass through an orifice co-axial to the hollow cylinder;

such method also comprises the steps of pulling, through the orifice, the elastic thread yarn consisting of the substantially inextensible yarn wound about the elastic thread, and winding the elastic thread yarn at a predetermined winding speed about a third spool, the main feature of the method being that the winding speed, the unwinding speed of the elastic thread and the speed of the cylinder are selected in such a way to wind a number of windings of the substantially inextensible yarn per each linear meter of the elastic thread yarn which is obtained by the equation:

$$T=K(1000\ \mathrm{Nm})^{\alpha} \quad [1]$$

where K is a number set between 20 and 50 and $\alpha$ is set between 0.30 and 0.35.

Such method can be carried out, for example, in a conventional hollow spindle twisting machine, where the cylinder, the orifice and the guide means for forming said centrifugal helical path are provided by such hollow spindle.

In particular, K is a number set between 25 and 47, more in particular, it is set between 30 and 42, even more in particular, K is a number set between 35 and 40, even more in particular, K is about 37.3. In particular $\alpha$ is a number set between 0.32 and 0.33.

DESCRIPTION OF PREFERRED EXEMPLARY EMBODIMENTS

The invention will be now shown with reference to the attached FIGURE and to the examples, not limitative, of elasticized products according to the invention, wherein an elastic thread yarn is produced using a hollow spindle twisting machine.

FIG. 1 shows a Cartesian diagram where the abscissa relates to the metric count of elastic thread yarns and the ordinate relates to the number of windings, i.e. the number of torsions given to a substantially inextensible linen, or ramié or hemp yarn, per linear meter of said elastic thread yarn.

In the diagram, some points are identified by the symbols Δ (or ▲), ●, □ (or ■) which correspond to elastic thread yarns according to the invention, characterized by a metric count value Nm and by a number T of windings given to the initial substantially inextensible yarn per each meter of yarn produced.

In particular, for each metric count value, a couple of points are identified by the symbols Δ (or ▲), □ (or ■), and lays on the same vertical line, to indicate, for a determined metric count Nm corresponding to such vertical line, a winding number range by which products are obtained which show an acceptable compromise between elastic properties and surface features, with particular reference to the so-called "orange skin" defect. On the same vertical line, an intermediate point is identified with the symbol (●) to indicate, for the same metric count value, a preferred value of the number of windings, i.e. of torsions.

The points Δ (or ▲), ●, □ (or ■) fit three approximation curves 12, 13, 14, respectively, wherein:

curve 12 shows the number T of windings per meter which leads to a surface irregularity density of the fabrics made of this yarn which lays within the acceptability limits. In particular, such number of windings can be fitted by a curve 12 of equation:

$$T=25.9(1000\ N)^{0.327} \quad [2];$$

curve 13 shows the number T of windings per meter below which the yarn, and the fabric obtained from them, has elastic properties suitable for making an elasticized item, in particular a fabric that is adapted to make general-purpose garments. In particular, these numbers of windings can be fitted by a curve 13 described by the equation:

$$T=46.7(1000\ N)^{0.327} \quad [3];$$

curve 14 shows the number T of windings per meter which makes it possible to obtain an elastic thread yarn with the best balance between surface regularity and elasticity. In particular, these numbers of windings can be fitted by a curve 14 described by the equation:

$$T=37.3(1000\ N)^{0.327} \quad [4].$$

Therefore, if for any metric count Nm* a number T of windings is selected in an area 14 proximate to curve 11, this best property balance can be obtained for metric count Nm*.

In particular, twist tests were made to obtain the elasticized product according to the invention, starting from linen, ramié or hemp inextensible yarns, by a Hamel-type hollow spindle twisting machine. Some examples of yarns, and of fabrics according to the invention are described hereinafter.

Examples of Elastic Thread Yarns Obtained from Linen Inextensible Yarns of Various Metric Counts, and of Fabrics Obtained Starting from Such Yarns On a hollow spindle twisting machine, elastic thread yarns were made starting from linen inextensible yarns. The elastic properties of these elastic thread yarns were determined with reference to UNI EN 15930:2010 standard.

Tables 1 and 2 show the properties of the material used, the production working conditions and the elastic properties, with reference to some exemplary test linen yarns.

In particular, the examples 1 and 2 of table 1 relate to elastic thread yarns obtained using thick elastic threads (156 dtex), whereas the examples 3, 4 and 5 of table 2 relate to elastic thread yarns obtained using thin elastic threads (44 and 78 dtex).

TABLE 1

| | EXAMPLE 1 | EXAMPLE 2 |
|---|---|---|
| Core elastic thread | Lycra ®, 156 dtex | Lycra ®, 156 dtex |
| Inextensible yarn metric count, Nm | 26 | 39 |
| Winding speed of produced yarn | m/minute | m/minute |
| Unwinding speed of elastic thread | m/minute | m/minute |
| Spindle rotation speed | RPM | RPM |
| Stretch ratio | 3.9 | 3.9 |
| Number of twisting/meter | 1100 S | 1300 S |
| Elastic recovery | 94% | 88.8% |
| Permanent stretch | 65% | 127.2% |

TABLE 2

| | EXAMPLE 3 | EXAMPLE 4 | EXAMPLE 5 |
|---|---|---|---|
| Core elastic thread | Lycra ®, 44dtex | Lycra ®, 78dtex | Lycra ®, 78 dtex |
| Inextensible yarn metric count, Nm | 39 | 39 | 26 |
| Winding speed of produced yarn | m/minute | m/minute | 8 m/minute |
| Unwinding speed of elastic thread | m/minute | m/minute | 2-3 m/minute |
| Spindle rotation speed | RPM | RPM | 12'000 RPM |
| Stretch ratio | 3.9 | 3.9 | 3.9 |
| Number of twisting/meter | 1100 S | 1300 S | 1120 S |
| Elastic recovery | 89.2% | 89.2% | |
| Permanent stretch | 117.8% | 122.7% | |

The number of windings has been determined by taking a sample of the predetermined length and by fixing this first sample between a first fixed clamp and a second rotatable clamp, in order to untwist the sample and to count the number of turns that must be applied to the sample to obtain a thread substantially parallel to a yarn, i.e. the thread that forms the core of the product and the substantially inextensible yarn that has been used. As described, this method complies with EN ISO 2061 standard.

In all cases, five 300 mm specimens were used for assessing the elastic properties. The specimens were subjected to a 0.01 cN/tex initial load, and to a progressive elongation at a test speed of 50 mm/minute, which gave 50% specific elongation. In such conditions, 4 60 seconds load cycles were carried out. Making an exception to the above-mentioned standard, the elastic thread yarn was pre-treated in water at 90° C. for 15 minutes.

The elastic thread yarn of the example 5 had the following properties:

I) Steam-Treated Yarn
average ultimate strength: 1026 cN;
average ultimate elongation: 8.3%

II) Elastic Thread Yarn Free in Steamed Skein
average ultimate strength: 1040 cN;
average ultimate elongation: 19.3%

The above-mentioned properties were obtained according to ISO 2062:2010 standard, method "A", carrying out in the cases I) and II) twenty-five tests with a 25 cm yarn test length, at an initial tensile stretch load of 0.21 N and at displacement speed of 250 mm/min. A CRE-Hounsfield dynamometer was used, equipped with a type of uncoated terminal clamps.

The results show that the above linen yarns have the properties of an elasticized yarn, and that they are well-suited for making elasticized fabrics.

| Metric count, Nm | T, windings/meter |
|---|---|
| 10 | 700 |
| 24, 36 | 1100 |
| 50, 75 | 1300. |

Fabrics were produced by arranging the above-described linen elastic thread yarns according to the weft direction. The elastic properties of these elastic thread yarns were determined with reference to UNI EN 14704-1:2005 standard.

The features of the material used, the production working conditions and the elastic properties are given in table 3.

TABLE 3

| | EXAMPLE 6 | | EXAMPLE 7 | |
|---|---|---|---|---|
| Covering yarn | see Example 1 | | see Example 2 | |
| Under load fabric elongation | 47.6 | | 49.5 | |
| Force decay due to time | 37.5 | | 29.0 | |
| Force decay due to exercising | 80.1 | | 49.3 | |
| Relaxation time | 1 minute | 30 minutes | 1 minute | 30 minutes |
| Fabric growth after relaxation | 21.8% | 15.6% | 16.2% | 10% |
| Recovered elongation | 78.2% | 84.4% | 83.8% | 90% |
| Elastic recovery | 164.4% | 177.4% | 160.5% | 172.4% |
| Modulus at 30% of elongation, N | 5.87 | 5.87 | 5.8 | 5.8 |

In both cases, for computing the elastic properties ten 200 mm strip specimens were used. The specimens were subjected to five elongation cycles at a 100 mm/minute test speed. In such conditions, a load of 30 N was applied to the specimens during a 30 minutes application period. By "modulus" it is meant the force recorded during the last load cycle, at a predetermined elongation. The measurement uncertainty at 95% probability is ±20% of under-load elongation and ±20% of the residual elongation.

The results show that the fabrics obtained from linen yarns have properties suitable for making elasticized items, in particular general-purpose cloth items.

Furthermore, the fabrics produced are substantially free from surface irregularities like the so-called "orange skin" effect.

Even with the yarn of example 5, an elasticized fabric was obtained which shows elastic properties only according to the weft direction, example 10. Such fabric was subjected to traction tests, in the weft and in the warp direction, according to EN ISO 13934-1:2000 standard. For the characterization three specimens were used of simply washed fabric and five specimens of refined fabric, which was refined by heating it up to a determined temperature and by maintaining the fabric at that temperature, i.e. by thermally stabilizing the fabric. Even in this case, the 200 mm specimens were stabilized at a fixed test speed of 100 mm/minute, after applying an initial tensile stretch of 5 N, in the case of the simply washed fabric, and of 2 N in the case of the refined, thermally stabilized fabric. The results are shown in tables 4 and 5.

TABLE 4

EXAMPLE 10: SIMPLY WASHED FABRIC

| | Warp | Weft |
|---|---|---|
| Average ultimate strength, N | 1200 | 670 |
| Maximum elongation % | 8.0 | 47.0 |

TABLE 5

EXAMPLE 6: REFINED, THERMALLY STABILIZED FABRIC

| | Warp | Weft |
|---|---|---|
| Average ultimate strength, N | 740 | 440 |
| Maximum elongation % | 13.0 | 34.0 |

Examples of Elastic Thread Yarns Obtained from Ramié Inextensible Yarns Based (*Boehmeria nivea*) of Various Metric Counts, and of Fabrics Obtained Starting from Such Yarns On a hollow spindle twisting machine, elastic thread yarns were made starting from inextensible ramié yarns. The elastic properties of these elastic thread yarns were determined with reference to UNI EN 15930:2010 standard.

Table 6 shows the properties of the material used, the production working conditions and the elastic properties with reference to some exemplary test ramié yarns.

TABLE 6

| | EXAMPLE 11 | EXAMPLE 12 |
|---|---|---|
| Core elastic thread | Lycra ®, 156 dtex | Lycra ®, 156 dtex |
| Inextensible yarn metric count, Nm | 36 | 48 |
| Winding speed of produced yarn | m/minute | m/minute |
| Unwinding speed of elastic thread | m/minute | m/minute |
| Spindle rotation speed | RPM | RPM |

TABLE 6-continued

| | EXAMPLE 11 | EXAMPLE 12 |
|---|---|---|
| Stretch ratio | 3.9 | 3.9 |
| Number of twisting/meter | 1100 S | 1300 S |
| Elastic recovery | 96% | 97.6% |
| Permanent stretch | 75% | 85.7% |

In both cases, 5 300 mm specimens were used for assessing the elastic properties. The specimens were subjected to a 0.01 cN/tex initial load, and to a progressive elongation at a test speed of 50 mm/minute, which gave 50% specific elongation. In such conditions, 4 60 seconds load cycles were carried out. Making an exception to the above-mentioned standard, the elastic thread yarn was pre-treated in water at 90° C. for 15 minutes.

The results show that the above ramié yarns have the properties of an elasticized yarn, and that they are well-suited for making elasticized fabrics.

With similar results other yarns were also produced starting from ramié inextensible yarns of different metric counts:

| Metric count, Nm | T, windings/meter |
|---|---|
| 10 | 700 |
| 24 | 1100 |
| 60 | 1300. |

Fabrics were produced by arranging the above-described ramié elastic thread yarns according to the weft direction. The elastic properties of these elastic thread yarns were determined with reference to UNI EN 14704-1:2005 standard.

The features of the material used, the production working conditions and the elastic properties are given in table 7.

TABLE 7

| | EXAMPLE 13 | | EXAMPLE 14 | |
|---|---|---|---|---|
| Covering yarn | see Example 9 | | see Example 10 | |
| Under load fabric elongation | 51.8 | | 49.5 | |
| Force decay due to time | 29.6 | | 29.0 | |
| Force decay due to exercising | 49.6 | | 49.3 | |
| Relaxation time | 1 minute | 30 minutes | 1 minute | 30 minutes |
| Fabric growth after relaxation | 12.6% | 10% | 11.1% | 9% |
| Recovered elongation | 87.4% | 90% | 88.9% | 91% |
| Elastic recovery | 168.8% | 173.8% | 179.5% | 183.8% |
| Modulus at 30% of elongation, N | 6.46 | 6.46 | 7.18 | 7.18 |

In both cases, for computing the elastic properties ten 200 mm strip specimens were used. The specimens were subjected to 5 elongation cycles at a 100 mm/minute test speed. In such conditions, a load of 30 N was applied to the specimens during a 30 minutes application period. By "modulus" it is meant the force recorded during the last load cycle, at a predetermined elongation. The measurement uncertainty at 95% probability is ±20% of under-load elongation and ±20% of the residual elongation.

The results show that the fabrics obtained starting from ramié yarns have properties suitable for making elasticized items, in particular general-purpose cloth items.

Further elastic thread yarns were produced from 8 to 60 metric count ramié yarns, typically from ramié yarns of metric count selected among 10, 24, 36, 48 and 60, in such a way to produce a number of windings per meter of substantially inextensible yarn between 500 and 1600.

Furthermore, also in this case, the fabrics produced are substantially free from surface irregularities like the so-called "orange skin" effect.

Examples of Elastic Thread Yarns Obtained from Inextensible Hemp Yarns (*Cannabis sativa*) of Various Metric Counts, and of Fabrics Obtained Starting from Such Yarns On a hollow spindle twisting machine, elastic thread yarns were made starting from inextensible hemp yarns. The elastic properties of these elastic thread yarns were determined with reference to UNI EN 15930:2010 standard.

Table 8 shows the properties of the material used, the production working conditions and the elastic properties with reference to some exemplary test hemp yarns.

TABLE 8

| | EXAMPLE 15 | EXAMPLE 16 |
|---|---|---|
| Core elastic thread | Lycra ®, 156 dtex | Lycra ®, 156 dtex |
| Inextensible yarn metric count, Nm | 24 | 36 |
| Winding speed of produced yarn | m/minute | m/minute |
| Unwinding speed of elastic thread | m/minute | m/minute |
| Spindle rotation speed | RPM | RPM |
| Stretch ratio | 3.9 | 3.9 |
| Number of twisting/meter | 1100 S | 1100 S |
| Elastic recovery | 78% | 88.8% |
| Permanent stretch | 196% | 155% |

In both cases, 5 300 mm specimens were used for assessing the elastic properties. The specimens were subjected to a 0.01 cN/tex initial load, and to a progressive elongation at a test speed of 50 mm/minute, which gave 50% specific elongation. In such conditions, 4 60 seconds load cycles were carried out. Making an exception to the above-mentioned standard, the elastic thread yarn was pre-treated in water at 90° C. for 15 minutes.

The results show that the above hemp yarns have the properties of an elasticized yarn, and that they are well-suited for making elasticized fabrics.

With similar results other yarns were also produced starting from hemp inextensible yarns of different metric counts:

| Metric count, Nm | T, windings/meter |
|---|---|
| 10 | 700 |
| 18 | 900. |

Fabrics were produced by arranging the above-described hemp elastic thread yarns according to the weft direction. The elastic properties of these elastic thread yarns were determined with reference to UNI EN 14704-1:2005 standard.

The features of the material used, the production working conditions and the elastic properties are given in table 9.

TABLE 9

| | EXAMPLE 17 | EXAMPLE 18 |
|---|---|---|
| Covering yarn | see Example 15 | see Example 16 |
| Under load fabric elongation | 50.4 | 54.6 |

TABLE 9-continued

| | EXAMPLE 17 | | EXAMPLE 18 | |
|---|---|---|---|---|
| Force decay due to time | 33.4 | | 32.7 | |
| Force decay due to exercising | 72.6 | | 50.6 | |
| Relaxation time | 1 minute | 30 minutes | 1 minute | 30 minutes |
| Fabric growth after relaxation | 19.8% | 15.5% | 11.6% | 7.9% |
| Recovered elongation | 80.2% | 84.5% | 88.4% | 92.1% |
| Elastic recovery | 159.3% | 167.8% | 162.0% | 168.8% |
| Modulus at 30% of elongation, N | 4.7 | 4.7 | 5.14 | 5.14 |

In both cases, for computing the elastic properties 10 200 mm strip specimens were used. The specimens were subjected to 5 elongation cycles at a 100 mm/minute test speed. In such conditions, a load of 30 N was applied to the specimens during a 30 minutes application period. By "modulus" it is meant the force recorded during the last load cycle, at a predetermined elongation. The measurement uncertainty at 95% probability is ±20% of under-load elongation and ±20% of the residual elongation.

The results show that the fabrics obtained starting from hemp yarns have properties suitable for making elasticized items, in particular general-purpose cloth items.

Further elastic thread yarns were produced from 8 to 40 metric count ramié yarns, typically from ramié yarns of metric count selected among 10, 18, 24 and 36, in such a way to produce a number of windings per meter of substantially inextensible yarn between 700 and 1400, and of metric count 36, with a number of windings per meter set between 500 and 1600.

Furthermore, also in this case, the fabrics produced are substantially free from surface irregularities like the so-called "orange skin" effect.

The foregoing description of embodiments and of examples of the invention, and of the way of using the apparatus, will so fully reveal the invention according to the conceptual point of view, so that others, by applying current knowledge, will be able to modify and/or adapt for various applications such embodiment without further research and without parting from the invention, and, then it is therefore to be understood that such adaptations and modifications will have to be considered as equivalent to the specific embodiment. The means and the materials to realise the different functions described herein could have a different nature without, for this reason, departing from the field of the invention. It is to be understood that the phraseology or terminology the is employed herein is for the purpose of description and, therefore, not of limitation.

The invention claimed is:

1. An elastic thread yarn comprising:

an elastic thread, comprising a thread made of an elastomeric material;

a substantially inextensible covering yarn that is helically wound about said elastic thread forming a predetermined number T of covering windings per length unit of said elastic thread yarn, wherein said substantially inextensible covering yarn comprises linen and/or ramie and/or hemp, said inextensible covering yarn having a predetermined metric count Nm, wherein said metric count Nm of said inextensible covering yarn is set between 8 Km/Kg and 80 Km/Kg (10000/8÷10000/80 dtex);

wherein said covering windings are arranged next to each other to entirely cover said elastic thread according to a number T of covering windings which is responsive to a predetermined function of the metric count T=T(Nm), and wherein said predetermined function of the metric count T=T(Nm) is given by the equation:

$$T=T(\mathrm{Nm})=K(1000\ \mathrm{Nm})^{\alpha} \quad [1]$$

where K is a number set between 25.9 and 46.7, and α is 0.327.

2. The yarn according to claim 1, wherein K is a number set between 30 and 42.

3. The yarn according to claim 1, wherein K is a number set between 35 and 40.

4. The elastic thread yarn according to claim 1, wherein said substantially inextensible covering yarn is a linen yarn that has a metric count Nm of 10 Km/Kg, and said number T of covering windings is set between 650 and 850 windings per meter of elastic thread yarn.

5. The elastic thread yarn according to claim 1, wherein said substantially inextensible covering yarn is a linen yarn that has a metric count Nm of 24 Km/Kg, and said number T of covering windings is set between 850 and 1250 windings per meter of elastic thread yarn.

6. The elastic thread yarn according to claim 1, wherein said substantially inextensible covering yarn is a linen yarn that has a metric count Nm of 26 Km/Kg, and said number T of covering windings is set between 900 and 1250 windings per meter of elastic thread yarn.

7. The elastic thread yarn according to claim 1, wherein said substantially inextensible covering yarn is a linen yarn that has a metric count Nm of 36 Km/Kg, and said number T of covering windings is set between 900 and 1350 windings per meter of elastic thread yarn.

8. The elastic thread yarn according to claim 1, wherein said substantially inextensible covering yarn is a linen yarn that has a metric count Nm of 39 Km/Kg, and said number T of covering windings is set between 900 and 1350 windings per meter of elastic thread yarn.

9. The elastic thread yarn according to claim 1, wherein said substantially inextensible covering yarn is a linen yarn that has a metric count Nm of 50 Km/Kg, and said number T of covering windings is set between 900 and 1600 windings per meter of elastic thread yarn, in particular said number T of covering windings is set between 1000 and 1500.

10. The elastic thread yarn according to claim 1, wherein said substantially inextensible covering yarn is a linen yarn that has a metric count Nm of 75 Km/Kg, and said number T of covering windings is set between 1100 and 1700 windings per meter of elastic thread yarn.

11. The elastic thread yarn according to claim 1, wherein the substantially inextensible covering yarn is a ramie yarn that has a metric count set between 8 and 60.

12. The elastic thread yarn according to claim 1, wherein said substantially inextensible covering yarn is a ramie yarn that has a metric count Nm of 10 Km/Kg, and said number T of covering windings is set 650 and 850 windings per meter of elastic thread yarn.

13. The elastic thread yarn according to claim 1, wherein said substantially inextensible covering yarn is a ramie yarn that has a metric count Nm of 24 Km/Kg, and said number T of covering windings is set between 850 and 1250 windings per meter of elastic thread yarn.

14. The elastic thread yarn according to claim 1, wherein said substantially inextensible covering yarn is a ramie yarn that has a metric count Nm of 36 Km/Kg, and said number T of covering windings is set between 900 and 1350 windings per meter of elastic thread yarn.

15. The elastic thread yarn according to claim 1, wherein said substantially inextensible covering yarn is a ramie yarn that has a metric count Nm of 48 Km/Kg, and said number T of covering windings is set between 1000 and 1500 windings per meter of elastic thread yarn.

16. The elastic thread yarn according to claim 1, wherein said substantially inextensible covering yarn is a ramie yarn that has a metric count Nm of 60 Km/Kg, and said number T of covering windings is set between 1000 and 1500 windings per meter of elastic thread yarn.

17. The elastic thread yarn according to claim 1, wherein the substantially inextensible covering yarn is a hemp yarn that has a metric count set between 8 and 40.

18. The elastic thread yarn according to claim 1, wherein said substantially inextensible covering yarn is a hemp yarn that has a metric count Nm of 10 Km/Kg, and said number T of covering windings is set between 650 and 850 windings per meter of elastic thread yarn.

19. The elastic thread yarn according to claim 1, wherein said substantially inextensible covering yarn is a hemp yarn that has a metric count Nm of 18 Km/Kg, and said number T of covering windings is set between 750 and 1150 windings per meter of elastic thread yarn.

20. The elastic thread yarn according to claim 1, wherein said substantially inextensible covering yarn is a hemp yarn that has a metric count Nm of 24 Km/Kg, and said number T of covering windings is set between 850 and 1250 windings per meter of elastic thread yarn.

21. The elastic thread yarn according to claim 1, wherein said substantially inextensible covering yarn is a hemp yarn that has a metric count Nm of 36 Km/Kg, and said number T of covering windings is set between 900 and 1350 windings per meter of elastic thread yarn.

22. The elastic thread yarn according to claim 1, wherein said thread of elastomeric material has a metric count set between 70 dtex and 250 dtex.

23. An elastic thread yarn according to claim 1, wherein:

said elastic thread is a Lycra elastic thread that has a metric count of 44 dtex;

said substantially inextensible covering yarn is a linen inextensible covering yarn;

said metric count Nm of said linen inextensible covering yarn is 39 Km/Kg;

said linen inextensible covering yarn is S-twisted in said windings;

said number T of covering windings per length unit is 1100 twistings per meter;

said elastic thread yarn is produced at a stretch ratio of 3.9.

24. An elastic thread yarn according to claim 1, wherein:

said elastic thread is a Lycra elastic thread that has a metric count of 78 dtex;

said substantially inextensible covering yarn is a linen inextensible covering yarn;

said metric count Nm of said linen inextensible covering yarn is 26 Km/Kg;

said linen inextensible covering yarn is S-twisted in said windings;

said number T of covering windings per length unit is 1120 twistings per meter;

said elastic thread yarn is produced on a hollow spindle twisting machine at a hollow spindle rotation speed of 12000 RPM;

said elastic thread yarn is produced at a stretch ratio of 3.9.

25. The elastic thread yarn according to claim 1, wherein said thread of elastomeric material has a metric count set between 100 dtex and 200 dtex.

26. The elastic thread yarn according to claim 1, wherein said elastic thread is a bare elastic thread.

27. The elastic thread yarn according to claim 1, wherein said elastic thread is an elastic thread coated with a natural fibre.

28. A method for making an elastic thread yarn comprising the steps of:

prearranging a first spool containing a substantially inextensible covering yarn comprising linen and/or ramie and/or hemp, wherein said substantially inextensible covering yarn has a metric count Nm set between 8 and 80 (10000/8÷10000/80 dtex);

prearranging a second spool containing a yarn comprising an elastic thread, wherein said elastic thread is made of an elastomeric material;

co-axially mounting said first spool on a hollow spindle that is adapted to rotate about its own axis at a predetermined speed;

pulling said elastic thread from said second spool through said hollow spindle at an unwinding speed;

causing said elastic thread with said linen and/or ramie and/or hemp-containing yarn to pass through an orifice co-axial to said hollow spindle;

said method comprising, furthermore, steps of pulling, through said orifice, said elastic thread yarn consisting of said substantially inextensible covering yarn wound about said elastic thread, and winding said elastic thread yarn at a predetermined winding speed about a third spool, wherein such method is carried out on a hollow spindle twisting machine, wherein the hollow spindle, the orifice and a guide means for forming said centrifugal helical path are provided by such hollow spindle twisting machine, wherein said winding speed, said unwinding speed of said elastic thread and said speed of said hollow spindle are selected in such a way to wind a number of covering windings of said substantially inextensible covering yarn per each linear meter of said elastic thread yarn which is obtained by the equation $$T=K(1000\ \mathrm{Nm})^{\alpha} \quad [1]$$

where K is a number set between 25.9 and 46.7 and a 0.327, and wherein said covering windings are arranged next to each other to entirely cover said elastic thread.

29. The method according to claim 28, wherein K is a number set between 30 and 42.

30. The method according to claim 28, wherein K is a number set between 35 and 40, in particular is a number about 37.3.

31. An elastic thread yarn according to claim 1, wherein:

said elastic thread is a Lycra elastic thread that has a metric count of 156 dtex;

said inextensible covering yarn is a linen inextensible covering yarn;

said metric count Nm of said linen inextensible covering yarn is 39 Km/Kg;

said linen inextensible covering yarn is S-twisted in said covering windings;

said number T of covering windings per length unit is 1300 twistings per meter;

said elastic thread yarn is produced at a stretch ratio of 3.9.

32. An elastic thread yarn according to claim 1, wherein:

said elastic thread is a spandex elastic thread that has a metric count of 156 dtex;

said inextensible covering yarn is a linen inextensible covering yarn;

said metric count Nm of said linen inextensible covering yarn is 26 Km/Kg;

said linen inextensible covering yarn is S-twisted in said covering windings;

said number T of covering windings per length unit is 1100 twistings per meter;

said elastic thread yarn is produced at a stretch ratio of 3.9.

33. The yarn according to claim 3, wherein K is 37.3.

34. The elastic thread yarn according to claim 27, wherein said natural fiber is at least one of a cotton and a viscose fiber.

* * * * *